US011583007B2

(12) United States Patent
Lee et al.

(10) Patent No.: US 11,583,007 B2
(45) Date of Patent: Feb. 21, 2023

(54) METHOD FOR IMPLEMENTING FEEDBACK CONTROL FUNCTION OF AEROSOL GENERATING APPARATUS, AND AEROSOL GENERATING APPARATUS

(71) Applicant: KT&G CORPORATION, Daejeon (KR)

(72) Inventors: Jae Min Lee, Siheung-si (KR); Hun Il Lim, Seoul (KR); Sang Kyu Park, Hwaseong-si (KR); Seung Won Lee, Gwangmyeong-si (KR); Hyung Jin Jung, Seoul (KR); Young Je Kim, Seoul (KR)

(73) Assignee: KT&G CORPORATION, Daejeon (KR)

( * ) Notice: Subject to any disclaimer, the term of this patent is extended or adjusted under 35 U.S.C. 154(b) by 414 days.

(21) Appl. No.: 16/645,194

(22) PCT Filed: Aug. 10, 2018

(86) PCT No.: PCT/KR2018/009153
§ 371 (c)(1),
(2) Date: Mar. 6, 2020

(87) PCT Pub. No.: WO2019/066245
PCT Pub. Date: Apr. 4, 2019

(65) Prior Publication Data

US 2020/0260791 A1 Aug. 20, 2020

(30) Foreign Application Priority Data

Sep. 26, 2017 (KR) ..... 10-2017-0124560
Aug. 7, 2018 (KR) ..... 10-2018-0092052

(51) Int. Cl.
*A24F 40/53* (2020.01)
*A24F 40/46* (2020.01)
(Continued)

(52) U.S. Cl.
CPC ..... *A24F 40/53* (2020.01); *A24F 40/46* (2020.01); *A24F 40/51* (2020.01); *A24F 40/57* (2020.01)

(58) Field of Classification Search
None
See application file for complete search history.

(56) References Cited

U.S. PATENT DOCUMENTS 9,872,521 B2 1/2018 Farine et al.
10,051,890 B2 8/2018 Mironov et al.
(Continued)

FOREIGN PATENT DOCUMENTS

CN 105027016 A 11/2015
EP 2 022 350 A1 2/2009
(Continued)

OTHER PUBLICATIONS

International Search Report dated Nov. 22, 2018 in International Application No. PCT/KR2018/009153.
(Continued)

*Primary Examiner* — James Harvey
(74) *Attorney, Agent, or Firm* — Sughrue Mion, PLLC

(57) ABSTRACT

According to an embodiment of the present disclosure, an aerosol generating apparatus having a feedback control function includes a heater configured to heat an aerosol generating substrate to generate an aerosol; a controller configured to generate a control signal for controlling power supplied to the heater; a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison
(Continued)

value calculated by comparing the comparison target signal with a reference signal exceeding a preset range.

19 Claims, 6 Drawing Sheets

(51) Int. Cl.
*A24F 40/57* (2020.01)
*A24F 40/51* (2020.01)

(56) References Cited

U.S. PATENT DOCUMENTS

| | | | | |
|---|---|---|---|---|
| 10,448,670 | B2 | 10/2019 | Talon et al. | |
| 11,133,692 | B2 * | 9/2021 | Akao | H01M 10/4264 |
| 11,259,573 | B2 * | 3/2022 | Qiu | A24F 40/40 |
| 2015/0189916 | A1 | 7/2015 | Wu | |
| 2015/0257445 | A1 | 9/2015 | Henry, Jr. et al. | |
| 2016/0172099 | A1 * | 6/2016 | Panet | H01F 27/2804 |
| 2017/0049151 | A1 | 2/2017 | Xue et al. | |
| 2017/0143043 | A1 | 5/2017 | Liu | |
| 2017/0196273 | A1 | 7/2017 | Qiu | |
| 2020/0260791 | A1 * | 8/2020 | Lee | A24F 40/57 |

FOREIGN PATENT DOCUMENTS

| | | | |
|---|---|---|---|
| EP | 2701268 | A1 | 2/2014 |
| JP | 2949114 | B1 | 9/1999 |
| KR | 10-1119356 | B1 | 3/2012 |
| KR | 10-2013-0052119 | A | 5/2013 |
| KR | 10-2014-0118985 | A | 10/2014 |
| KR | 10-1619034 | B1 | 5/2016 |
| KR | 10-1667177 | B1 | 10/2016 |
| WO | 2016166064 | A1 | 10/2016 |

OTHER PUBLICATIONS

Notice of Non-Final Rejection dated Aug. 20, 2019, from the Korean Intellectual Property Office in Application No. 10-2018-0092052.

Notice of Reasons for Refusal dated Jan. 19, 2021 from the Japanese Patent Office in JP Application No. 2020-501519.

Communication dated Jun. 25, 2021 from the China National Intellectual Property Administration in application No. 201880047359.0.

Communication dated May 25, 2021, from the European patent Office in application No. 18863473.7.

* cited by examiner

METHOD FOR IMPLEMENTING FEEDBACK CONTROL FUNCTION OF AEROSOL GENERATING APPARATUS, AND AEROSOL GENERATING APPARATUS

TECHNICAL FIELD

The present disclosure relates to a method of implementing a feedback control function of an aerosol generating apparatus and an aerosol generating apparatus using the method, and more particularly, to a method capable of generally increasing stability in an operation of an aerosol generating apparatus in which a controller indispensably included in the aerosol generating apparatus receives and uses a response signal to a control signal to generate a control signal output at a next time and the aerosol generating apparatus using the method.

BACKGROUND ART

Recently, there has been a growing demand for alternative methods for resolving problems of common cigarettes. For example, instead of a method of generating an aerosol by burning a cigarette, there has been a growing demand for a method of generating an aerosol by heating an aerosol generating material of a cigarette. Therefore, research into heating-type cigarettes or heating-type aerosol generating apparatuses is being actively conducted.

The aerosol generating apparatus may include a heater for generating an aerosol by generally heating an aerosol generating substrate and a separate main controller unit (MCU) to control power supplied to the heater. Although the MCU performs a function of controlling the overall operation of the aerosol generating apparatus according to an internally predefined logic, a logic lexically defined in the MCU tends to assume that the operation of the aerosol generating apparatus is performed without any defects or malfunctions, which causes a problem in that, when any defects or malfunctions occur a specific component constituting the aerosol generating apparatus or complicatedly occur with other components, it is too late or impossible for the MCU to cope with defects or malfunctions of the specific component constituting the aerosol generating apparatus.

For example, in commercially available aerosol generating apparatuses, even if the user lowers the temperature of the heater through a thermostat, the current supplied through a heating wire may not correctly flow according to a temperature setting state and may gradually increase, and when the user does not recognize this and leaves the aerosol generating apparatus without shutting off the power, the aerosol generating apparatus may be damaged by the heat emitted from the heating wire or furthermore a fire may occur.

In addition, the heater of the aerosol generating apparatus includes a temperature sensor that detects the temperature of the heater. The temperature sensor may periodically or aperiodically transmit the temperature value of the heater to the MCU such that the MCU determines whether the heater is heated. However, when the temperature of the heater does not rise even though the user applies an input to a heating switch to heat the heater of the aerosol generating apparatus, there may be a problem in that the MCU has difficulty in determining whether the temperature of the heater does not rise due to the disconnection of the heater or, despite the rise in the temperature of the heater, whether the rise in the temperature is not detected due to a defect that has occurred in the temperature sensor.

DETAILED DESCRIPTION

Technical Problem

Provided is an aerosol generating apparatus that may quickly cope with a malfunction of the aerosol generating apparatus, through a feedback control function.

Solution to Problem

According to an aspect of the present disclosure, an aerosol generating apparatus includes a heater configured to heat an aerosol generating substrate to generate an aerosol; a controller configured to generate a control signal for controlling power supplied to the heater; a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison value calculated by comparing the comparison target signal with a reference signal exceeding a preset range.

According to another aspect of the present disclosure, a method of implementing a feedback control function of an aerosol generating apparatus includes generating a control signal for controlling power supplied to a heater; transmitting the generated control signal to a switch that performs a switching operation; calculating a comparison target signal by receiving a signal by the switching operation, and generating a cut-off signal for stopping the switching operation of the switch based on a comparison value calculated by comparing the comparison target signal with a reference signal exceeding a preset range.

According to another aspect of the present disclosure, a non-transitory computer-readable recording medium storing a program for implementing the method is provided.

Advantageous Effects

According to the present disclosure, a user of an aerosol generating apparatus may quickly discover a malfunction in the aerosol generating apparatus and thus, promptly repair it.

BEST MODE

Figure 1:
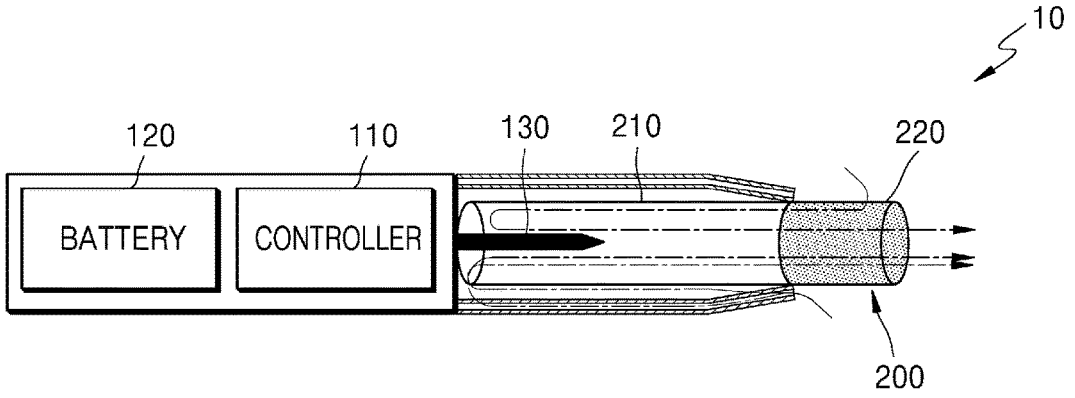
FIGS. 1 through 3 are diagrams showing examples in which a cigarette is inserted into an aerosol generating device.

According to an aspect of the present disclosure, an aerosol generating apparatus includes a heater configured to heat an aerosol generating substrate to generate an aerosol; a controller configured to generate a control signal for controlling power supplied to the heater; a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison value calculated by comparing the comparison target signal with a reference signal exceeding a preset range.

The control signal may be a pulse width modulation (PWM) signal.

The reference signal may be a PWM signal, the comparison target signal may be a reverse PWM signal, and the comparison value may be calculated based on duty ratios of PWM signal and the reverse PWM signal.

The comparison signal calculator may include an RC filter configured to receive the signal by the switching operation and convert the signal into a triangular wave signal; and a DC converter configured to convert the converted triangular wave signal into an analog DC signal, and the controller may be further configured to generate the cut-off signal based on a result of comparing the converted analog DC signal with the reference signal.

The comparison signal calculator may include a voltage output sensor configured to detect a temperature of the heater and output a heater voltage proportional to a resistance value of the heater; and an AD converter configured to convert the output heater voltage into a digital value, and the controller may be further configured to, based on a comparison value calculated by comparing the converted heater voltage with a preset voltage value exceeding a preset range, generate the cut-off signal for stopping the switching operation of the switch.

The comparison signal calculator may be an integrator configured to receive the signal by the switching operation and output an integration result signal, and the comparison value may be a duty ratio of the output integration result signal with respect to a duty ratio of the control signal.

The preset range may be 0.7 to 1.3.

The switch may be a field effect transistor (FET) configured to perform an on/off operation according to the control signal.

The aerosol generating apparatus may further include a regulator configured to maintain an output voltage of the battery as a constant.

According to another aspect of the present disclosure, a method of implementing a feedback control function of an aerosol generating apparatus includes generating a control signal for controlling power supplied to a heater; transmitting the generated control signal to a switch that performs a switching operation; calculating a comparison target signal by receiving a signal by the switching operation, and generating a cut-off signal for stopping the switching operation of the switch based on a comparison value calculated by comparing the comparison target signal with a reference signal exceeding a preset range.

The control signal may be a pulse width modulation (PWM) signal.

The reference signal may be a PWM signal, the comparison target signal may be a reverse PWM signal, and the comparison value may be calculated according to duty ratios of PWM signal and the reverse PWM signal.

The calculating the comparison target signal may include converting the signal by the switching operation into a triangular wave signal by receiving the signal; and converting the converted triangular wave signal into an analog DC signal, and the generating the cut-off signal may include generating the cut-off signal based on a result of comparing the converted analog DC signal with the reference signal.

The calculating the comparison target signal may include outputting a heater voltage proportional to a resistance value of the heater by detecting a temperature of the heater; and converting the output heater voltage into a digital value, and the generating of the cut-off signal may include, based on a comparison value calculated by comparing the converted heater voltage with a preset voltage value exceeding a preset range, generating the cut-off signal for stopping the switching operation of the switch.

The calculating the comparison target signal may include receiving the signal by the switching operation and outputting an integration result signal, and the comparison value may be a duty ratio of the output integration result signal with respect to a duty ratio of the control signal.

The preset range may be 0.7 to 1.3.

The switch may be a field effect transistor (FET) configured to perform an on/off operation according to the control signal.

The method may further include maintaining an output voltage of the battery as a constant.

According to another aspect of the present disclosure, a non-transitory computer-readable recording medium storing a program for implementing the method is provided.

MODE OF DISCLOSURE

As the present disclosure allows for various changes and numerous embodiments, particular embodiments will be illustrated in the drawings and described in detail in the written description. The accompanying drawings for illustrating the present disclosure are referred to in order to gain a sufficient understanding, the merits thereof, and the objectives accomplished by the implementation. However, the present disclosure may have different forms and should not be construed as being limited to the descriptions set forth herein.

The embodiments of the present disclosure will be described below in more detail with reference to the accompanying drawings. Those elements that are the same or are in correspondence are rendered the same reference numeral regardless of the figure number, and redundant explanations are omitted.

While such terms as "first," "second," etc., may be used to describe various elements, such elements must not be limited to the above terms. The above terms are used only to distinguish one element from another.

An expression used in the singular encompasses the expression of the plural, unless it has a clearly different meaning in the context.

In the present disclosure, it is to be understood that the terms such as "including," "having," and "comprising" are intended to indicate the existence of the features or elements disclosed in the disclosure, and are not intended to preclude the possibility that one or more other features or elements may exist or may be added.

When a certain embodiment may be implemented differently, a specific process order may be performed differently from the described order. For example, two consecutively described processes may be performed substantially at the same time or performed in an order opposite to the described order.

Hereinafter, embodiments of the present disclosure will be described in detail with reference to the drawings.

Figure 2:
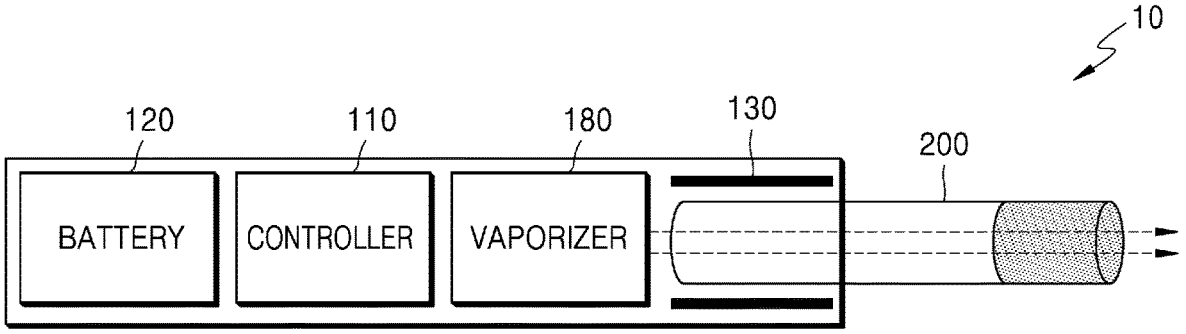
Figure 3:
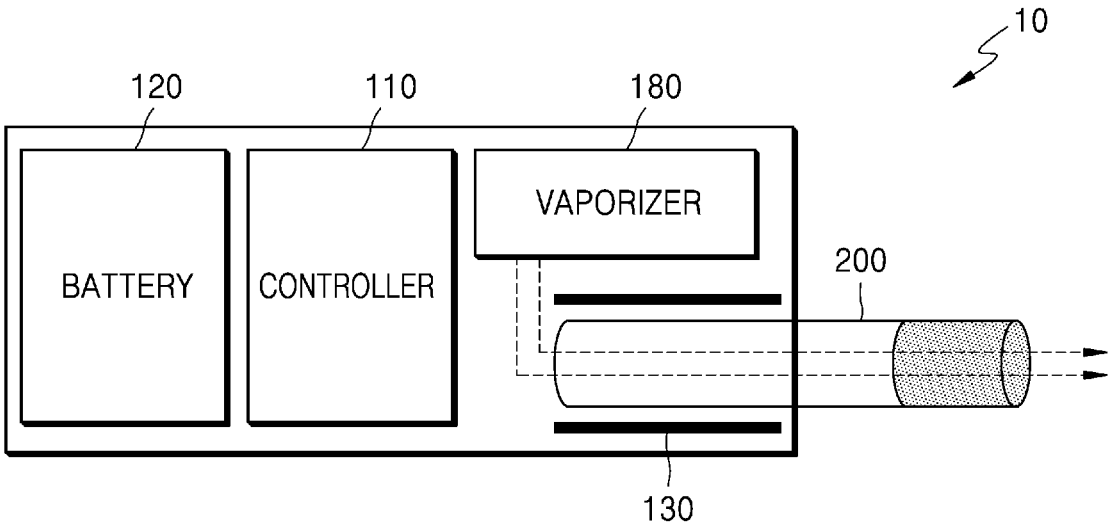

FIGS. 1 through 3 are diagrams showing examples in which a cigarette is inserted into an aerosol generating device.

Referring to FIG. 1, the aerosol generating device 10 may include a battery 120, a controller 110, and a heater 130. Referring to FIGS. 2 and 3, the aerosol generating device 10 may further include a vaporizer 180. Also, the cigarette 200 may be inserted into an inner space of the aerosol generating device 10.

FIGS. 1 through 3 illustrate components of the aerosol generating device 10, which are related to the present embodiment. Therefore, it will be understood by one of ordinary skill in the art related to the present embodiment that other general-purpose components may be further included in the aerosol generating device 10, in addition to the components illustrated in FIGS. 1 through 3.

Also, FIGS. 2 and 3 illustrate that the aerosol generating device 10 includes the heater 130. However, according to necessity, the heater 130 may be omitted.

FIG. 1 illustrates that the battery 120, the controller 110, and the heater 1300 are arranged in series. Also, FIG. 2 illustrates that the battery 120, the controller 110, the vaporizer 180, and the heater 130 are arranged in series. Also, FIG. 3 illustrates that the vaporizer 180 and the heater 130 are arranged in parallel. However, the internal structure of the aerosol generating device 10 is not limited to the structures illustrated in FIGS. 1 through 3. In other words, according to the design of the aerosol generating device 10, the battery 120, the controller 110, the heater 130, and the vaporizer 180 may be differently arranged.

When the cigarette 200 is inserted into the aerosol generating device 10, the aerosol generating device 10 may operate the heater 130 and/or the vaporizer 180 to generate an aerosol from the cigarette 200 and/or the vaporizer 180. The aerosol generated by the heater 130 and/or the vaporizer 180 is delivered to a user by passing through the cigarette 200.

According to necessity, even when the cigarette 200 is not inserted into the aerosol generating device 10, the aerosol generating device 10 may heat the heater 130.

The battery 120 may supply power to be used for the aerosol generating device 10 to operate. For example, the battery 120 may supply power to heat the heater 130 or the vaporizer 180, and may supply power for operating the controller 110. Also, the battery 120 may supply power for operations of a display, a sensor, a motor, etc. mounted in the aerosol generating device 10.

The controller 110 may generally control operations of the aerosol generating device 10. Specifically, the controller 110 may control not only operations of the battery 120, the heater 130, and the vaporizer 180, but also operations of other components included in the aerosol generating device 10. Also, the controller 110 may check a state of each of the components of the aerosol generating device 10 to determine whether or not the aerosol generating device 10 is able to operate.

The controller 110 may include at least one processor. A processor may be implemented as an array of a plurality of logic gates or may be implemented as a combination of a general-purpose microprocessor and a memory in which a program executable in the microprocessor may be stored. It will be understood by one of ordinary skill in the art that the processor may be implemented in other forms of hardware.

The heater 130 may be heated by the power supplied from the battery 120. For example, when the cigarette 200 is inserted into the aerosol generating device 10, the heater 130 may be located outside the cigarette 200. Thus, the heated heater 130 may increase the temperature of an aerosol generating material in the cigarette 200.

The heater 130 may include an electro-resistive heater. For example, the heater 130 may include an electrically conductive track, and the heater 130 may be heated when currents flow through the electrically conductive track. However, the heater 130 is not limited to the example described above and may include all heaters which may be heated to a desired temperature. Here, the desired temperature may be pre-set in the aerosol generating device 10 or may be set as a temperature desired by a user.

As another example, the heater 130 may include an induction heater. Specifically, the heater 130 may include an electrically conductive coil for heating a cigarette in an induction heating method, and the cigarette may include a susceptor which may be heated by the induction heater.

For example, the heater 130 may include a tube-type heating element, a plate-type heating element, a needle-type heating element, or a rod-type heating element, and may heat the inside or the outside of the cigarette 200, according to the shape of the heating element.

Also, the aerosol generating device 10 may include a plurality of heaters 130. Here, the plurality of heaters 130 may be inserted into the cigarette 200 or may be arranged outside the cigarette 200. Also, some of the plurality of heaters 130 may be inserted into the cigarette 200 and the others may be arranged outside the cigarette 200. In addition, the shape of the heater 130 is not limited to the shapes illustrated in FIGS. 1 through 3 and may include various shapes.

The vaporizer 180 may generate an aerosol by heating a liquid composition and the generated aerosol may pass through the cigarette 200 to be delivered to a user. In other words, the aerosol generated via the vaporizer 180 may move along an air flow passage of the aerosol generating device 10 and the air flow passage may be configured such that the aerosol generated via the vaporizer 180 passes through the cigarette 200 to be delivered to the user.

For example, the vaporizer 180 may include a liquid storage, a liquid delivery element, and a heating element, but it is not limited thereto. For example, the liquid storage, the liquid delivery element, and the heating element may be included in the aerosol generating device 10 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 180 or may be formed integrally with the vaporizer 180.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 180 may be referred to as a cartomizer or an atomizer, but it is not limited thereto.

The aerosol generating device 10 may further include general-purpose components in addition to the battery 120, the controller 110, the heater 130, and the vaporizer 180. For example, the aerosol generating device 10 may include a display capable of outputting visual information and/or a motor for outputting haptic information. Also, the aerosol generating device 10 may include at least one sensor (a puff detecting sensor, a temperature detecting sensor, a cigarette insertion detecting sensor, etc.). Also, the aerosol generating device 10 may be formed as a structure where, even when the cigarette 200 is inserted into the aerosol generating device 10, external air may be introduced or internal air may be discharged.

Although not illustrated in FIGS. 1 through 3, the aerosol generating device 10 and an additional cradle may form together a system. For example, the cradle may be used to charge the battery 120 of the aerosol generating device 10. Alternatively, the heater 130 may be heated when the cradle and the aerosol generating device 10 are coupled to each other.

The cigarette 200 may be similar as a general combustive cigarette. For example, the cigarette 200 may be divided into a first portion including an aerosol generating material and a second portion including a filter, etc. Alternatively, the second portion of the cigarette 200 may also include an aerosol generating material. For example, an aerosol generating material made in the form of granules or capsules may be inserted into the second portion.

The entire first portion may be inserted into the aerosol generating device 10, and the second portion may be exposed to the outside. Alternatively, only a portion of the first portion may be inserted into the aerosol generating device 10, or the entire first portion and a portion of the second portion may be inserted into the aerosol generating device 10. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 10. For example, the opening and closing and/or a size of the air passage formed in the aerosol generating device 10 may be adjusted by the user. Accordingly, the amount of smoke and a smoking satisfaction may be adjusted by the user. As another example, the external air may flow into the cigarette 200 through at least one hole formed in a surface of the cigarette 200.

Hereinafter, an example of the cigarette 200 will be described with reference to FIG. 4.

Figure 4:
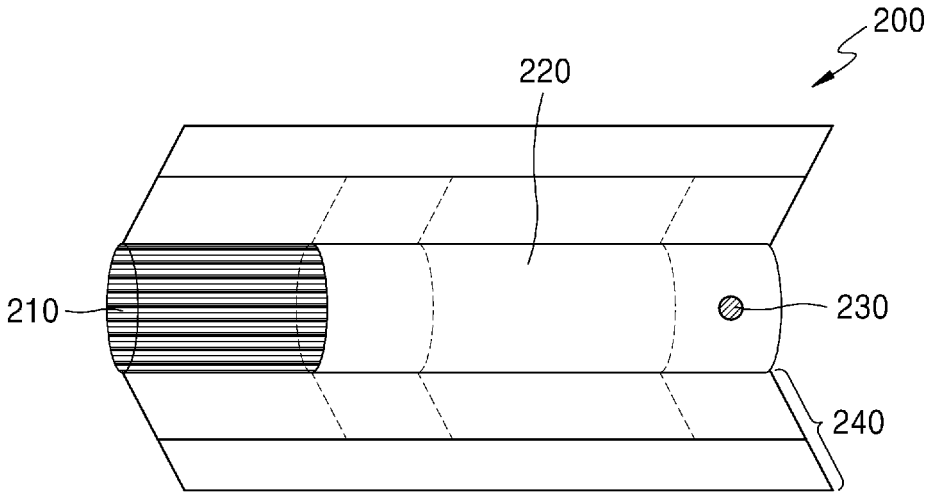
FIG. 4 illustrates an example of a cigarette.

FIG. 4 illustrates an example of a cigarette.

Referring to FIG. 4, the cigarette 200 may include a tobacco rod 210 and a filter rod 220. The first portion 210 described above with reference to FIGS. 1 through 3 may include the tobacco rod, and the second portion 220 may include the filter rod 220.

FIG. 4 illustrates that the filter rod 220 includes a single segment. However, the filter rod 220 is not limited thereto. In other words, the filter rod 220 may include a plurality of segments. For example, the filter rod 220 may include a first segment configured to cool an aerosol and a second segment configured to filter a certain component included in the aerosol. Also, according to necessity, the filter rod 220 may further include at least one segment configured to perform other functions.

The cigarette 200 may be packaged via at least one wrapper 240. The wrapper 240 may have at least one hole through which external air may be introduced or internal air may be discharged. For example, the cigarette 200 may be packaged via one wrapper 240. As another example, the cigarette 200 may be double-packaged via at least two wrappers 240. For example, the tobacco rod 210 may be packaged via a first wrapper, and the filter rod 220 may be packaged via a second wrapper. Also, the tobacco rod 210 and the filter rod 220, which are respectively packaged via separate wrappers, may be coupled to each other, and the entire cigarette 200 may be packaged via a third wrapper. When each of the tobacco rod 210 and the filter rod 220 includes a plurality of segments, each segment may be packaged via a separate wrapper. Also, the entire cigarette 200 including the plurality of segments, which are respectively packaged via the separate wrappers and which are coupled to each other, may be re-packaged via another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet. Also, the tobacco rod 210 may be surrounded by a heat conductive material. For example, the heat-conducting material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Also, the shapes of the filter rod 220 are not limited hereto. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected into the filter rod 220, or an additional fiber coated with a flavoring liquid may be inserted into the filter rod 220.

Also, the filter rod 220 may include at least one capsule 230. Here, the capsule 230 may generate a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Although not illustrated in FIG. 4, the cigarette 200 according to an embodiment may further include a front-end filter. The front-end filter may be located on a side of the tobacco rod 210, the side facing the filter rod 220. The front-end filter may prevent the tobacco rod 210 from being detached outwards and prevent a liquefied aerosol from flowing into the aerosol generating device 10 (FIGS. 1 through 3) from the tobacco rod 210, during smoking.

Figure 5:
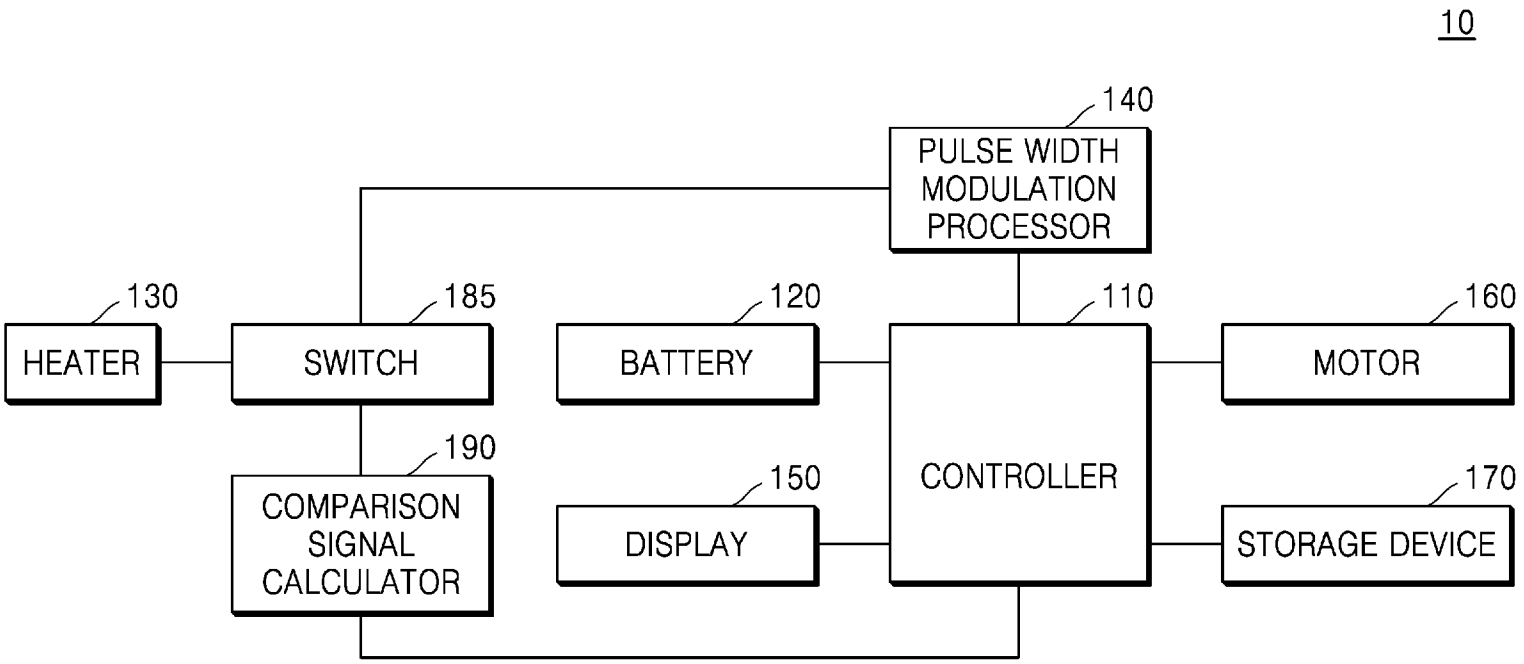
FIG. 5 is a block diagram schematically showing an example of an aerosol generating apparatus according to an embodiment.

FIG. 5 is a diagram schematically showing a block diagram of an example of an aerosol generating apparatus 10 according to an embodiment.

Referring to FIG. 5, the aerosol generating apparatus 10 according to the present disclosure may include the controller 110, the battery 120, the heater 130, a pulse width modulation processor 140, a display 150, a motor 160, a storage device 170, a switch 185, and a comparison signal calculator 190.

For convenience of description, the general functions of the respective elements included in the aerosol generating apparatus 10 will be described first, and the operation of the controller 110 according to an embodiment will be described in detail.

The controller 110 may collectively control the battery 120, the heater 130, the pulse width modulation processor 140, the display 150, the motor 160, the storage device 170, the switch 185, and the comparison signal calculator 190 included in the aerosol generating apparatus 10. Although not shown in FIG. 5, according to an embodiment, the controller 110 may further include an input receiver (not shown) that receives a button input or a touch input of a user and a communicator (not shown) that communicates with an external communication device such as a user terminal. In addition, although not shown in FIG. 5, the controller 110 may further include a module for performing proportional integral differential (PID) control on the heater 130.

The battery 120 may supply power to the heater 130, and the magnitude of the power supplied to the heater 130 may be adjusted by a control signal output from the controller 110. According to an embodiment, a regulator may be included between the controller 110 and the battery 120 to maintain a constant voltage of the battery 120.

The heater 130 may generate heat by an intrinsic resistance when a current is applied. When an aerosol generating substrate contacts (couples to) the heated heater 130, an aerosol may be generated.

The pulse width modulation processor 140 may allow the controller 110 to control the power supplied to the heater 130 through a method of transmitting a PWM (pulse width modulation) signal to the heater 130. According to an embodiment, the PWM processor 140 may be implemented in a manner in which the PWM processor 140 is included in the controller 110, and the PWM signal output from the PWM processor 140 may be a digital PWM signal.

The display 150 may visually output various alarm messages generated by the aerosol generating apparatus 10 such that a user who uses the aerosol generating apparatus 10 may confirm the alarm messages. The user may confirm a battery power shortage message or an overheat warning message of the heater 130 output on the display 150 and take appropriate measures before an operation of the aerosol generating apparatus 10 stops or the aerosol generating apparatus 10 is damaged.

The motor 160 may be driven by the controller 110 to allow the user to perceive through the tactile sense that the aerosol generating apparatus 10 is ready for use.

The storage device 170 may store various information for the controller 110 to appropriately control the power supplied to the heater 130 and to provide various flavors to the user who uses the aerosol generating apparatus 10. The storage device 170 may not only be configured as a non-volatile memory like a flash memory, but also as a volatile memory that temporarily stores data only when electrically connected in order to secure a faster data input/output (I/O) speed.

The switch 185 may perform switching operation such that the control signal (the PWM signal) generated by the controller 110 or the pulse width modulation processor 140 is transmitted to the heater 130. As an example, power is supplied to the heater 130 when the switch 185 is on, and the power supplied to the heater 130 may be stopped when the switch 185 is off. The switching operation of the switch 185 may include not only an on-off operation of connecting or disconnecting the heater 130, but also an operation of contacting at least three terminals at different time points to constitute an open circuit or a closed circuit. Although not shown in FIG. 5, according to an embodiment, the switch 185 may further include a signal reverser that reverses a signal received from the controller 110 or the pulse width modulation processor 140. In addition, the switch 185 may be a field effect transistor (FET) that performs the on/off operation according to the control signal.

When the control signal generated from the controller 110 or the pulse width modulation processor 140 reaches the switch 185, the comparison signal calculator 190 receives a signal according to the switching operation of the switch 185 and calculates and transmits a comparison target signal to the controller 110. The controller 110 may receive the comparison target signal and store information stored in the comparison target signal as time series information in the storage device 170. According to an embodiment, the comparison signal calculator 190 may be implemented by being included in the controller 110.

The controller 110, the pulse width modulation processor 140 and the comparison signal calculator 190 according to an embodiment of the present disclosure may correspond to at least one or more processors or may include at least one or more processors. Accordingly, the controller 110, the pulse width modulation processor 140, and the comparison signal calculator 190 may be driven by being included in another hardware device such as a microprocessor or a general purpose computer system.

Hereinafter, the operation of the aerosol generating apparatus 10 will be described for each embodiment.

As an alternative embodiment, when a comparison value calculated by comparing the comparison target signal with a reference signal exceeds a preset range, the controller 110 may generate a cut-off signal for stopping the switching operation of the switch 185.

First, the controller 110 receives the comparison target signal from the comparison signal calculator 190. The comparison target signal received by the controller 110 is a feedback signal with respect to the control signal transmitted from the controller 110 or the pulse width modulation processor 140 and includes information necessary for the controller 110 to control each element included in the aerosol generating apparatus 10.

Here, the reference signal refers to information of a signal which is set in advance in the controller 110 or previously stored in the storage device 170 in order to be compared with the comparison target signal, and may be a control signal with respect to a time point corresponding to the comparison target signal. For example, when the controller 110 outputs the control signal at a time point t1, calculates the comparison target signal at a time point t2, and receives the comparison target signal at a time point t3, the reference signal may be the control signal at the time point t1.

The comparison value means a specific value calculated by the controller 110 by comparing the comparison target signal with the reference signal, and may be various values including the difference value of the amplitude of the comparison target signal and the reference signal, the difference value of frequency, the difference value of a duty ratio, etc. The preset range is defined as a value experimentally determined as information previously stored in the controller 110 or the storage device 170.

In an alternative embodiment, when the comparison value exceeds the preset range, the controller 110 may generate the cut-off signal for the switch 185 to control the switch 185 to stop the switching operation. Here, the cut-off signal may refer to a signal for turning off the switch 185 to cut off power applied from the battery 120 to the heater 130.

As another alternative embodiment, the comparison target signal may be a reverse pulse width modulation signal. According to the present alternative embodiment, the controller 110 may compare a duty ratio of the pulse width modulation signal which is the control signal with the reverse pulse width modulation signal which is the comparison target signal, calculate the comparison value, and when the comparison value exceeds the preset range, the controller 110 may generate the cut-off signal. A further description of the reverse pulse width modulation signal will be described later with reference to FIGS. 7 and 8.

Figure 6:
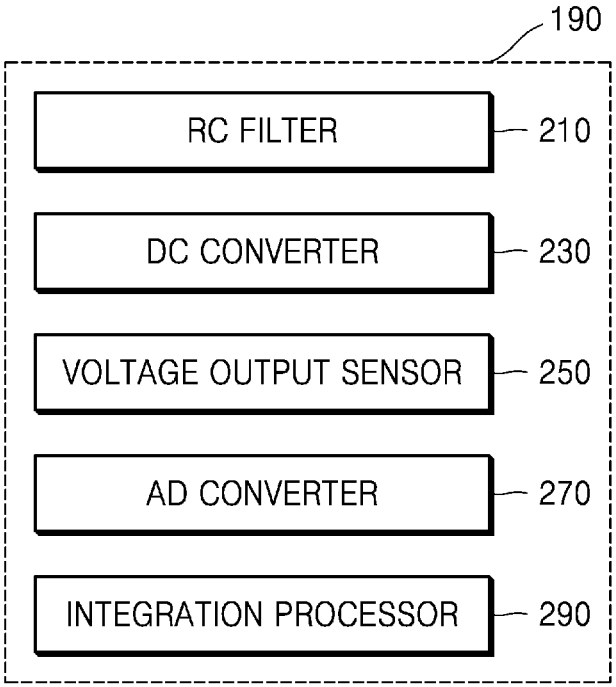
FIG. 6 is a diagram schematically showing an example of a comparison signal calculator.

FIG. 6 is a diagram schematically showing an example of the comparison signal calculator 190.

Referring to FIG. 6, the comparison signal calculator 190 may include an RC filter 210, a DC converter 230, a voltage output sensor 250, an AD converter 270, and an integration processor 290. According to an example, in the comparison signal calculator 190, at least one of the RC filter 210, the DC converter 230, the voltage output sensor 250, the AD converter 270, and the integral processor 290 may be omitted.

The RC filter 210 includes an RC circuit including a resistor and a capacitor, receives a signal by a switching operation of the switch 185 and converts the signal into a triangular wave. At this time, the signal by the switching operation of the switch 185 may be a digital PWM signal. In addition, an arrangement of the resistor and the capacitor included in the RC filter 210 may be configured as at least two or more capacitors as a predetermined arrangement. As an example, the RC filter 210 may include a CRC filter having one resistor connected in series between two capacitors having one pole grounded.

The DC converter 230 converts the triangular wave signal converted by the RC filter 210 into an analog DC signal. The analog DC signal converted by the DC converter 230 is transmitted to the controller 110 as a comparison target signal. The controller 110 may calculate a comparison value by comparing the converted analog DC signal with a reference signal, and when the comparison value exceeds a preset range, generate a cut-off signal.

The voltage output sensor 250 may detect the temperature of a heater and output a heater voltage proportional to the resistance value of the heater. The voltage output sensor 250 first identifies the resistance value of the heater by detecting the temperature of the heater.

$$R(T)=R_0[1+a(T-T_0)] \quad \text{[Equation 1]}$$

Equation 1 is an example of an equation used by the voltage output sensor 250 to detect the temperature of the heater and identify the resistance value of the heater. In Equation 1, R(T) denotes the resistance of the heater at a temperature T, $R_0$ denotes an initial heater resistance, T denotes the current temperature of the heater, $T_0$ denotes the initial temperature of the heater, a denotes the temperature coefficient of the heater. When the voltage output sensor 250 detects the temperature of the heater to identify the resistance of the heater, the voltage output sensor 250 outputs a voltage of the magnitude proportional to the resistance value.

The AD converter 270 converts the analog voltage of the heater output from the voltage output sensor 250 into a digital value. The controller 110 calculates a comparison value by comparing the digital voltage of the heater output from the AD converter 270 with a preset voltage value, when the comparison value exceeds a preset range, stops the switching operation of the switch 185, and generates a cut-off signal. At this time, the digital voltage of the heater output from the AD converter 270 is a comparison target signal, and the predetermined voltage value is a reference signal.

Figure 7:
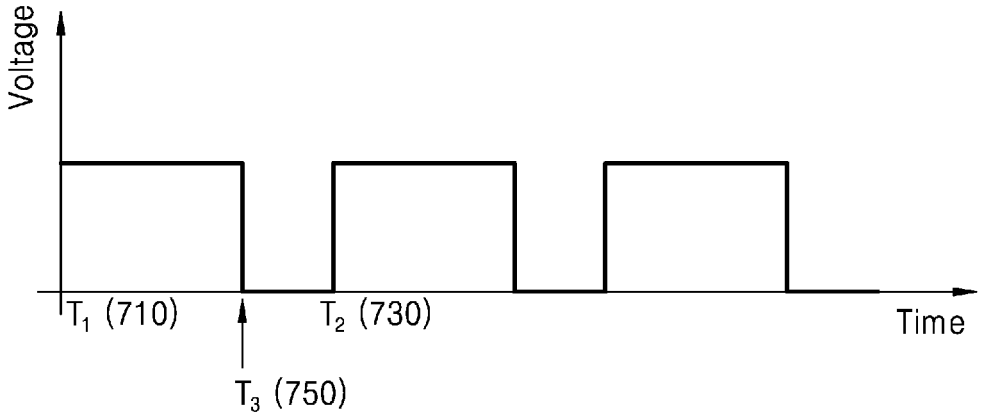
FIG. 7 is a diagram of an example of a control signal generated by a controller.

The integration processor 290 receives the voltage signal as an input and outputs an integration result signal of the voltage signal. Here, the signal received by the integration processor 290 may be a signal according to the switching operation of the switch 185. When the voltage signal received by the integration processor 290 is a PWM signal as shown in FIG. 7, the integration result signal is a voltage signal in the form of a triangular wave corresponding to the PWM signal. The controller 110 may calculate the duty ratio of the integration result signal with respect to the duty ratio of the control signal as the comparison value, and generate the cut-off signal when the comparison value exceeds the preset range.

FIG. 7 is a diagram of an example of a control signal generated by the controller 110.

Referring to FIG. 7, the control signal may be a PWM signal and has a constant duty ratio.

$$V_{eff} = \sqrt{\frac{1}{T_2 - T_1}\int_{T_1}^{T_2}[(V(t)]^2 dt} = \frac{V_B}{10}\sqrt{D} \quad \text{[Equation 2]}$$

Equation 2 defines an effective voltage $V_{eff}$ of the battery 120. In Equation 2, $V_B$ denotes a battery voltage, and $T_1$ and $T_2$ denote specific time points which are different from each other on the time axis. As shown in Equation 2, the effective voltage $V_{eff}$ between T1 and T2 may be maintained constantly by adjusting the duty ratio D even when the battery voltage $V_B$ drops.

$$D(\%) = \frac{T_3 - T_2}{T_2 - T_1} \times 100 \quad \text{[Equation 3]}$$

Equation 3 defines the duty ratio. The duty ratio refers to a ratio of the time that a current flows in a specific device or module with respect to the sum of the time that the current flows and the time that no current flows when the current is supplied to the device or the module in the form of a periodic pulse. According to an embodiment, the duty ratio may be defined for the voltage as well as the current. In Equation 3, $T_1$ 710 denotes a time point when a control signal for controlling the heater 130 is transmitted to the heater 130, $T_2$ 730 denotes a time point when one cycle of the control signal ends, and $T_3$ 750 denotes a time point when the current (voltage) in the control signal of the form of pulse is supplied to the heater 130 and then cut off.

The control signal is generated to keep the battery voltage $V_B$ at a constant for a predetermined period (T2–T1) according to the duty ratio calculated by the controller 110.

Figure 8:
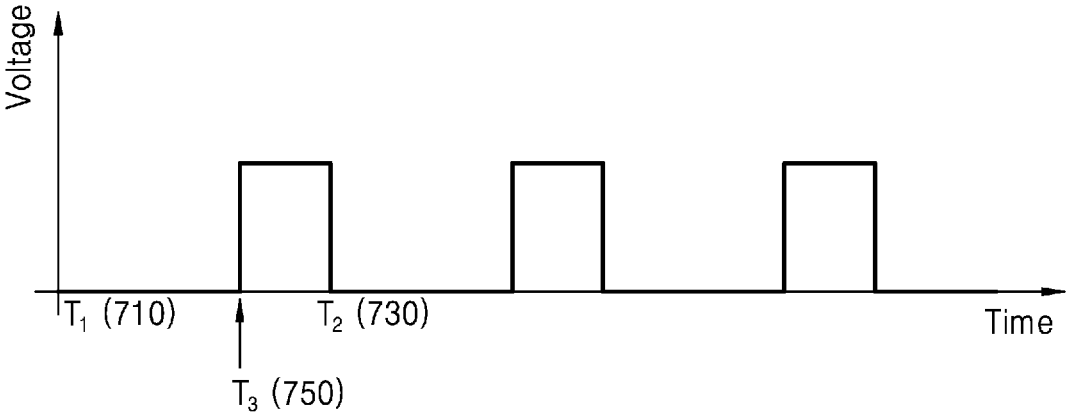
FIG. 8 is a diagram illustrating an example of a comparison target signal.

FIG. 8 is a diagram illustrating an example of a comparison target signal.

The comparison target signal of FIG. 8 means a signal in which the pulse width modulation signal described with reference to FIG. 7 is reversed by passing through the switch 185 or the comparison signal calculator 190. The duty ratio according to Equation 3 may also be applied to the reversed signal, and when the duty ratio of a control signal is 50% and the comparison target signal is fed back by the control signal and transmitted to the controller 110, the duty ratio of the comparison target signal and the duty ratio of the control signal are the same. The controller 110 calculates a difference between the duty ratios of the control signal and the comparison target signal as a comparison value, and generates a cut-off signal when the calculated comparison value exceeds a preset range.

As an example, the comparison value calculated by the controller 110 may be the duty ratio of the comparison target signal with respect to the duty ratio of the control signal.

$$C = \frac{D_2}{D_1} \quad \text{[Equation 4]}$$

Equation 4 shows an example of an equation used by the controller 110 to calculate the comparison value. In Equation 4, C denotes the comparison value, $D_1$ denotes the duty ratio of the control signal, and $D_2$ denotes the duty ratio of the comparison target signal. Equation 4 is an example of an equation that may be used by the controller 110 to calculate the comparison value, and thus, according to an embodiment, the controller 110 may compare the comparison value based on a different equation from Equation 4 and determine whether to generate the cut-off signal based on the calculated comparison value.

After calculating the comparison value, the controller 110 may determine whether the comparison value exceeds a preset range. The preset range may be 0.7 to 1.3. According to a preferred embodiment, the controller 110 may determine whether the comparison value exceeds 0.8 to 1.2 to determine whether to generate the cut-off signal.

In particular, according to the embodiment in which the comparison signal calculator 190 of FIG. 6 includes the integration processor 290, the integration processor 290 may apply a preset range to generate an integration result signal, and the integration result signal may have an error by the preset range with respect to the control signal. The controller 110 may receive the integration result signal, determine whether the integration result signal has the error by the preset range with respect to the control signal, and determine whether to generate the cut-off signal.

As described above, when the comparison signal calculator 190 is an integrator including the integration processor 290 according to an embodiment of the present disclosure, the comparison signal calculator 190 may accurately detect the disconnection of the heater 130 of the aerosol generating apparatus 10. For example, even though a user applies an input to the heater heating button of the aerosol generating apparatus 10 to inhale an aerosol, when the temperature of the heater 130 does not change, the heater 130 may be disconnected or the temperature sensor of the heater 130 may be broken. At this time, the controller 110 may receive an integration result signal as a result of transmitting the control signal to the integrator, calculate a comparison value according to the duty ratios of the control signal and the integration result signal according to Equation 4 and then determine whether the comparison value exceeds the preset range, and when the comparison value does not exceed the preset range, determine that the heater 130 is not disconnected. When the comparison value exceeds the preset range, the controller 110 may determine that the heater 130 is disconnected and transmit the cut-off signal, thereby preventing unnecessary switching of the switch 185 and minimizing the waste of power in the battery 120.

Figure 9:
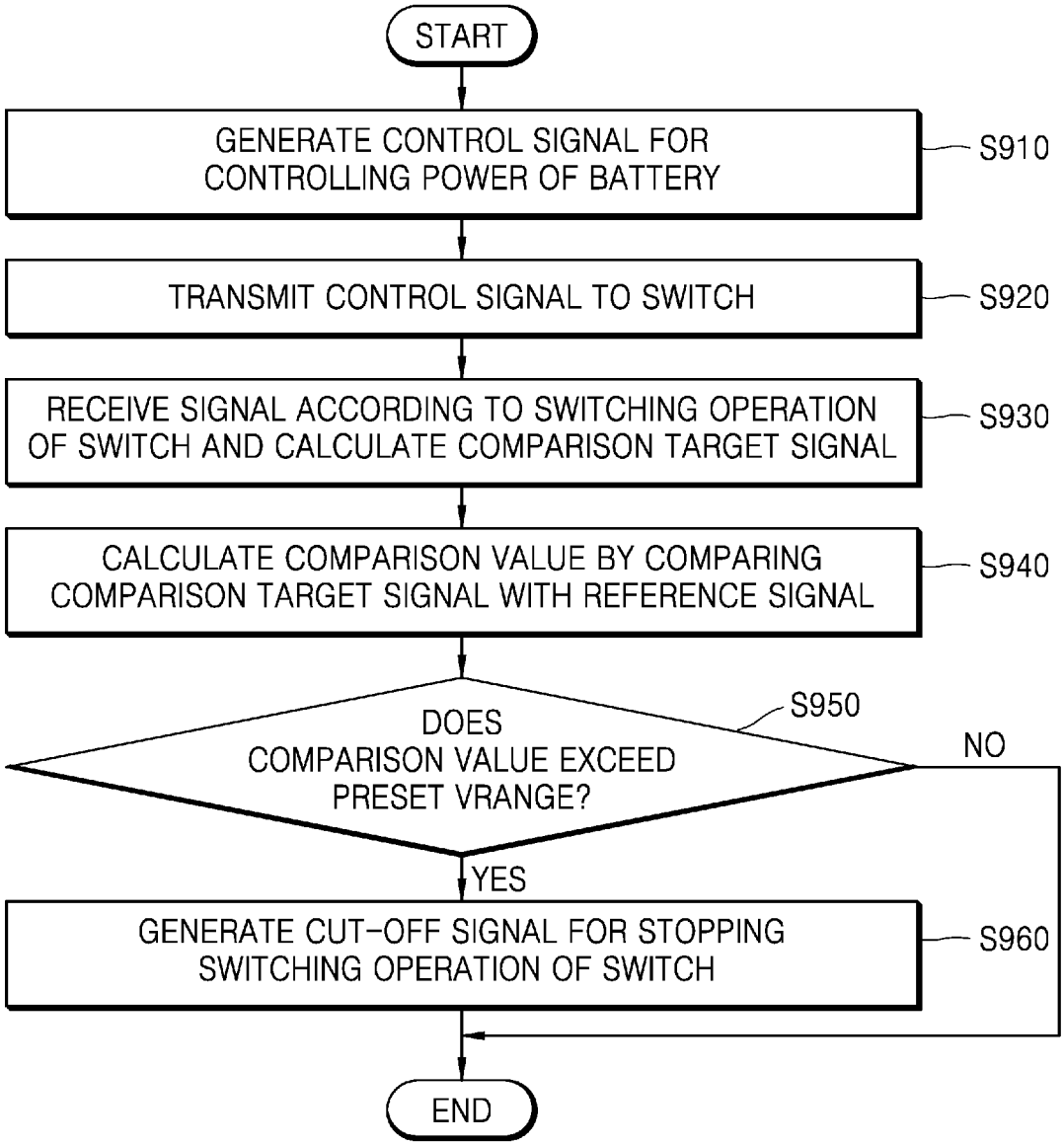
FIG. 9 is a flowchart illustrating an example of a method of implementing a feedback control function of an aerosol generating apparatus according to an embodiment.

FIG. 9 is a flowchart illustrating an example of a method of implementing a feedback control function of the aerosol generating apparatus 10 according to an embodiment.

The method according to FIG. 9 may be implemented by the aerosol generating apparatus 10 according to FIG. 5, and thus the method will be described with reference to FIG. 5, and the description already described with reference to FIG. 5 will be omitted below.

The controller 110 generates a control signal for controlling the power of a battery (S910).

The controller 110 transmits the control signal generated in operation S910 to the switch 185 (S920).

The comparison signal calculator 190 receives a signal according to the switching operation of the switch 185 and calculates a comparison target signal (S930). Here, the signal according to the switching operation means the latter when the control signal is identified as a signal (which means values of $T_1$ 710 to $T_3$ 750 in FIG. 7) for supplying power to a heater according to the on/off operation of the switch 185 or a signal indicating a voltage of 0 according to characteristics of a PWM signal (which means values of $T_3$ 750 to $T_2$ 730 in FIG. 7), and the switch 185 calculates a signal as in FIG. 8 through a signal reverser and transmits the signal to the comparison signal calculator 190.

The controller 110 calculates a comparison value by comparing the comparison target signal with a reference signal (S940).

The controller 110 determines whether the comparison value calculated in operation S940 exceeds a preset range (S950).

When it is determined in operation S950 that the comparison value exceeds the preset range, the controller 110 may generate a cut-off signal for stopping the switching operation of the switch 185 and transmit the cut-off signal to the switch 185 (S960). According to an embodiment, in operation S960, the switch 185 may be a FET.

According to the present disclosure, by digitally processing a control signal output from a heat-type aerosol generating apparatus that is essentially accompanied by a heater using a feedback function, a moment when a high voltage is instantaneously input may be accurately determined, and thus various components constituting the aerosol generating apparatus may be protected.

In addition, the aerosol generating apparatus according to the present disclosure may control various signals through a feedback control method with an integrator circuit embedded therein, thereby accurately determining whether a heater is disconnected or a temperature sensor provided in the heater is broken.

Embodiments according to the present disclosure described above may be implemented in the form of a computer program that may be executed through various elements on a computer, and such a computer program may be recorded in a computer-readable medium. In this regard, examples of the medium may include magnetic media such as a hard disk, a floppy disk, and magnetic tape, optical media such as compact disk read only memory (CD-ROM) and digital versatile disk (DVD), magneto-optical media such as a floptical disk, and a hardware device especially configured to store and execute a program command, such as read only memory (ROM), random access memory (RAM) and flash memory, etc.

Meanwhile, the computer program may be a program command specially designed and configured for the present disclosure or a program command known to be used by those of skill in the art of the computer software field. Further, examples of the program commands include machine language code created by a compiler and high-level language code executable by a computer using an interpreter.

The particular implementations shown and described in the present disclosure are illustrative examples and are not intended to otherwise limit the scope of the present disclosure in any way. For the sake of brevity, conventional electronics, control systems, software development and other functional aspects of the systems may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the present disclosure unless the element is specifically described as "essential" or "critical".

Herein (especially, in the claims), the use of "the" and other demonstratives similar thereto may correspond to both a singular form and a plural form. Also, when a range is described in the present disclosure, the range has to be regarded as including disclosure adopting any individual element within the range (unless described otherwise), and it has to be regarded as having written in the detailed description each individual element included in the range. Unless the order of operations of a method according to the present disclosure is explicitly mentioned or described otherwise, the operations may be performed in a proper order. The present disclosure is not limited to the order the operations are mentioned. The use of all examples or exemplary terms (e.g., "etc.,", "and (or) the like", and "and so forth") in the present disclosure is merely intended to describe the embodiment in detail, and the scope of the present disclosure is not necessarily limited by the examples or exemplary terms unless defined by the claims. Also, one of ordinary skill in the art may appreciate that the present disclosure may be configured through various modifications, combinations, and changes according to design conditions and factors without departing from the spirit and technical scope of the present disclosure and its equivalents.

INDUSTRIAL APPLICABILITY

An embodiment of the present disclosure may be used to manufacture an electronic cigarette device including a computing device for supplying power to a heater by using a battery.

What is claimed is:

1. An aerosol generating apparatus having a feedback control function, the aerosol generating apparatus comprising:

a heater configured to heat an aerosol generating substrate to generate an aerosol;

a controller configured to generate a control signal for controlling power supplied to the heater;

a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison value calculated by comparing the comparison target signal with a reference signal exceeding a preset range, wherein the reference signal is the control signal which is output from the controller at a first time point, and wherein the comparison target signal is a signal output from the comparison signal calculator at a second time point by switching operation of the switch according to the control signal which is output from the controller at the first time point.

2. The aerosol generating apparatus of claim 1, wherein the control signal is a pulse width modulation (PWM) signal.

3. The aerosol generating apparatus of claim 1, wherein the reference signal is a pulse width modulation signal, wherein the comparison target signal is a reverse pulse width modulation signal, and wherein the comparison value is calculated based on duty ratios of pulse width modulation signal and the reverse pulse width modulation signal.

4. An aerosol generating apparatus having a feedback control function, the aerosol generating apparatus comprising:

a heater configured to heat an aerosol generating substrate to generate an aerosol;

a controller configured to generate a control signal for controlling power supplied to the heater;

a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison value calculated by comparing the comparison target signal with a reference signal exceeding a preset range, wherein the comparison signal calculator comprises:

an RC filter configured to receive the signal by the switching operation and convert the signal into a triangular wave signal; and a DC converter configured to convert the converted triangular wave signal into an analog DC signal, and wherein the controller is further configured to generate the cut-off signal based on a result of comparing the converted analog DC signal with the reference signal.

5. The aerosol generating apparatus of claim 1, wherein the comparison signal calculator comprises:

a voltage output sensor configured to detect a temperature of the heater and output a heater voltage proportional to a resistance value of the heater; and an AD converter configured to convert the output heater voltage into a digital value, and wherein the controller is further configured to, based on a comparison value calculated by comparing the converted heater voltage with a preset voltage value exceeding a preset range, generate the cut-off signal for stopping the switching operation of the switch.

6. An aerosol generating apparatus having a feedback control function, the aerosol generating apparatus comprising:

a heater configured to heat an aerosol generating substrate to generate an aerosol;

a controller configured to generate a control signal for controlling power supplied to the heater;

a switch configured to perform a switching operation based on the control signal to supply the power to the heater; and a comparison signal calculator configured to receive a signal by the switching operation to calculate a comparison target signal, wherein the controller is further configured to generate a cut-off signal for stopping the switching operation of the switch based on a comparison value calculated by comparing the comparison target signal with a reference signal exceeding a preset range, wherein the comparison signal calculator is an integrator configured to receive the signal by the switching operation and output an integration result signal, and wherein the comparison value is a duty ratio of the output integration result signal with respect to a duty ratio of the control signal.

7. The aerosol generating apparatus of claim 6, wherein the preset range is 0.7 to 1.3.

8. The aerosol generating apparatus of claim 1, wherein the switch is a field effect transistor (FET) configured to perform an on/off operation according to the control signal.

9. The aerosol generating apparatus of claim 1, further comprising a regulator configured to maintain an output voltage of the battery as a constant.

10. A method of implementing a feedback control function of an aerosol generating apparatus, the method comprising:

generating a control signal for controlling power supplied to a heater;

transmitting the generated control signal to a switch that performs a switching operation;

calculating a comparison target signal by receiving a signal by the switching operation, and generating a cut-off signal for stopping the switching operation of the switch based on a comparison value calculated by comparing the comparison target signal with a reference signal exceeding a preset range, wherein the reference signal is the control signal which is output from a controller at a first time point, and wherein the comparison target signal is a signal output from a comparison signal calculator at a second time point by switching operation of the switch according to the control signal which is output from the controller at the first time point.

11. The method of claim 10, wherein the control signal is a pulse width modulation (PWM) signal.

12. The method of claim 10, wherein the reference signal is a pulse width modulation signal, wherein the comparison target signal is a reverse pulse width modulation signal, and wherein the comparison value is calculated by duty ratios of pulse width modulation signal and the reverse pulse width modulation signal.

13. A method of implementing a feedback control function of an aerosol generating apparatus, the method comprising:

generating a control signal for controlling power supplied to a heater;

transmitting the generated control signal to a switch that performs a switching operation;

calculating a comparison target signal by receiving a signal by the switching operation, and generating a cut-off signal for stopping the switching operation of the switch based on a comparison value calculated by comparing the comparison target signal with a reference signal exceeding a preset range, wherein the calculating of the comparison target signal comprises:

converting the signal by the switching operation into a triangular wave signal by receiving the signal; and converting the converted triangular wave signal into an analog DC signal, and wherein the generating the cut-off signal comprises generating the cut-off signal based on a result of comparing the converted analog DC signal with the reference signal.

14. The method of claim 10, wherein the calculating of the comparison target signal comprises:

outputting a heater voltage proportional to a resistance value of the heater by detecting a temperature of the heater; and converting the output heater voltage into a digital value, and wherein the generating the cut-off signal comprises, based on a comparison value calculated by comparing the converted heater voltage with a preset voltage value exceeding a preset range, generating the cut-off signal for stopping the switching operation of the switch.

15. The method of claim 10, wherein the calculating of the comparison target signal comprises:

receiving the signal by the switching operation and outputting an integration result signal, and wherein the comparison value is a duty ratio of the output integration result signal with respect to a duty ratio of the control signal.

16. The method of claim 10, wherein the preset range is 0.7 to 1.3.

17. The method of claim 10, wherein the switch is a field effect transistor (FET) configured to perform an on/off operation according to the control signal.

18. The method of claim 10, further comprising maintaining an output voltage of the battery as a constant.

19. A non-transitory computer-readable recording medium storing a program for implementing the method of claim 10.

* * * * *